US010098407B2

(12) United States Patent
Kele

(10) Patent No.: US 10,098,407 B2
(45) Date of Patent: Oct. 16, 2018

(54) HELMET WITH AIRFLOW VENTILATION THROUGH AN EARPAD

(71) Applicant: Bell Sports, Inc., Scotts Valley, CA (US)

(72) Inventor: Paul Kele, Scotts Valley, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 319 days.

(21) Appl. No.: 14/993,288

(22) Filed: Jan. 12, 2016

(65) Prior Publication Data

US 2016/0198787 A1 Jul. 14, 2016

Related U.S. Application Data

(60) Provisional application No. 62/102,165, filed on Jan. 12, 2015.

(51) Int. Cl.

| | |
|---|---|
| ***A42B 3/00*** | (2006.01) |
| ***A42B 3/28*** | (2006.01) |
| ***A42B 3/16*** | (2006.01) |
| *A42B 3/32* | (2006.01) |

(52) U.S. Cl.
CPC ..... *A42B 3/283* (2013.01); *A42B 3/16* (2013.01); *A42B 3/326* (2013.01)

(58) Field of Classification Search
CPC ..... A42B 3/16; A42B 3/283; A42B 3/326
USPC ..... 2/410, 411, 414, 422–425, 209
See application file for complete search history.

(56) References Cited

U.S. PATENT DOCUMENTS

| | | | | |
|---|---|---|---|---|
| 4,081,865 A | | 4/1978 | Bergee et al. | |
| 5,263,204 A | * | 11/1993 | Butsch | A42B 3/326 2/424 |
| 5,361,419 A | | 11/1994 | Bernstein | |
| 5,632,048 A | * | 5/1997 | Mortell | A42B 3/166 2/423 |

FOREIGN PATENT DOCUMENTS

| | | |
|---|---|---|
| EP | 0852917 | 7/1998 |

* cited by examiner

*Primary Examiner* — Katherine Moran
(74) *Attorney, Agent, or Firm* — Booth Udall Fuller, PLC

(57) ABSTRACT

A helmet can include a protective shell and a layer of energy management material coupled to an inner surface of the protective shell to form a cavity for receiving a head of a user. An earpad can be coupled to the inner surface of the protective shell that comprises an inner surface that further defines a space for an ear of a user. The earpad can further include a leading edge at a front of the helmet, the leading edge extending between the outer surface of the protective shell and the inner surface of the earpad. An air intake opening can be formed at the leading edge of the earpad. An air exhaust opening can be formed at a trailing edge of the earpad. An airflow channel can extend through the earpad between the air intake opening and the air exhaust opening.

20 Claims, 7 Drawing Sheets

HELMET WITH AIRFLOW VENTILATION THROUGH AN EARPAD

RELATED APPLICATIONS

This application claims the benefit of U.S. provisional patent application 62/102,165, filed Jan. 12, 2015 titled "Helmet Comprising Airflow Through Earpad Design," the entirety of the disclosure of which is hereby incorporated by this reference.

TECHNICAL FIELD

This disclosure relates to a helmet with airflow ventilation through an earpad. The airflow ventilation can be provided for a helmet with a releasably attached chinbar and can increase ventilation for a user when the chinbar is detached from the protective helmet.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact.

In addition to preventing or reducing damage or injury to the wearer of a helmet, conventional helmets have also included ventilation openings to allow for air circulation and airflow through a helmet. Ventilation and air circulation have increased comfort and allowed for temperature regulation and temperature mitigation for the user wearing the helmet. Conventional helmet ventilation openings have included ventilation openings that extend radially between an outer surface of the helmet and a center or cavity in the helmet for receiving a head of the helmet wearer.

SUMMARY

A need exists for a helmet with improved ventilation. Accordingly, in an aspect, a helmet can comprise a protective shell comprising an outer surface at an exterior of the helmet and an inner surface opposite the outer surface. A layer of energy management material can be coupled to the inner surface of the protective shell to form a cavity for receiving a head of a user. An earpad can be coupled to the inner surface of the protective shell that comprises an inner surface that further defines a space for an ear of a user. The earpad can further comprise a leading edge at a front of the helmet, the leading edge extending between the outer surface of the protective shell and the inner surface of the earpad. An air intake opening can be formed at the leading edge of the earpad. An air exhaust opening can be formed at a trailing edge of the earpad. An airflow channel can extend through the earpad between the air intake opening and the air exhaust opening.

The helmet can further comprise a ventilation opening formed through the protective shell that extends into the cavity. A foam comfort pad can be coupled to the inner surface of the earpad and disposed within the cavity. A removable chinbar can be coupled to the helmet, wherein the air intake opening is blocked when the removable chinbar is coupled to the protective shell. The airflow channel can comprise a width greater than or equal to 1 millimeter (mm). The airflow channel can comprise a cross-sectional area greater than or equal to 5 square mm. The air exhaust opening can be located along a bottom edge of the helmet. The earpad can be coupled adjacent the layer of energy management material.

In another aspect, a helmet can comprise a protective shell comprising an outer surface and an inner surface opposite the outer surface. A layer of energy management material can be coupled to the inner surface of the protective shell to form a cavity for receiving a head of a user. An earpad can be coupled to the inner surface of the protective shell that comprises an inner surface that further defines a space for an ear of a user. The earpad can further comprise an air intake opening in a leading edge of the earpad, an air exhaust opening, and an airflow channel extending through the earpad between the air intake opening and the air exhaust opening.

The helmet can further comprise a ventilation opening formed through the protective shell that extends into the cavity. A foam comfort pad can be coupled to the inner surface of the earpad and disposed within the cavity. The airflow channel can comprise a cross-sectional area greater than or equal to 5 square mm. The earpad can be coupled adjacent the layer of energy management material. The air exhaust opening can be located along a bottom edge of the helmet.

In yet another aspect, a helmet can comprise a protective shell comprising an outer surface and an inner surface opposite the outer surface. A layer of energy management material can be coupled to the inner surface of the protective shell. An earpad can be coupled to the inner surface of the protective shell and define a space for an ear of a user, the earpad further comprising an airflow channel that extends from a leading edge of the earpad through the earpad.

The helmet can further comprise a ventilation opening formed through the protective shell and extending in a direction substantially perpendicular to the airflow channel. A foam comfort pad can be coupled to the inner surface of the earpad. The helmet can comprise a removable chinbar, wherein the airflow channel is blocked when the removable chinbar is coupled to the protective shell. The airflow channel can comprise a width greater than or equal to 1 mm. The earpad is coupled adjacent the layer of energy management material.

DETAILED DESCRIPTION

Figure 1:
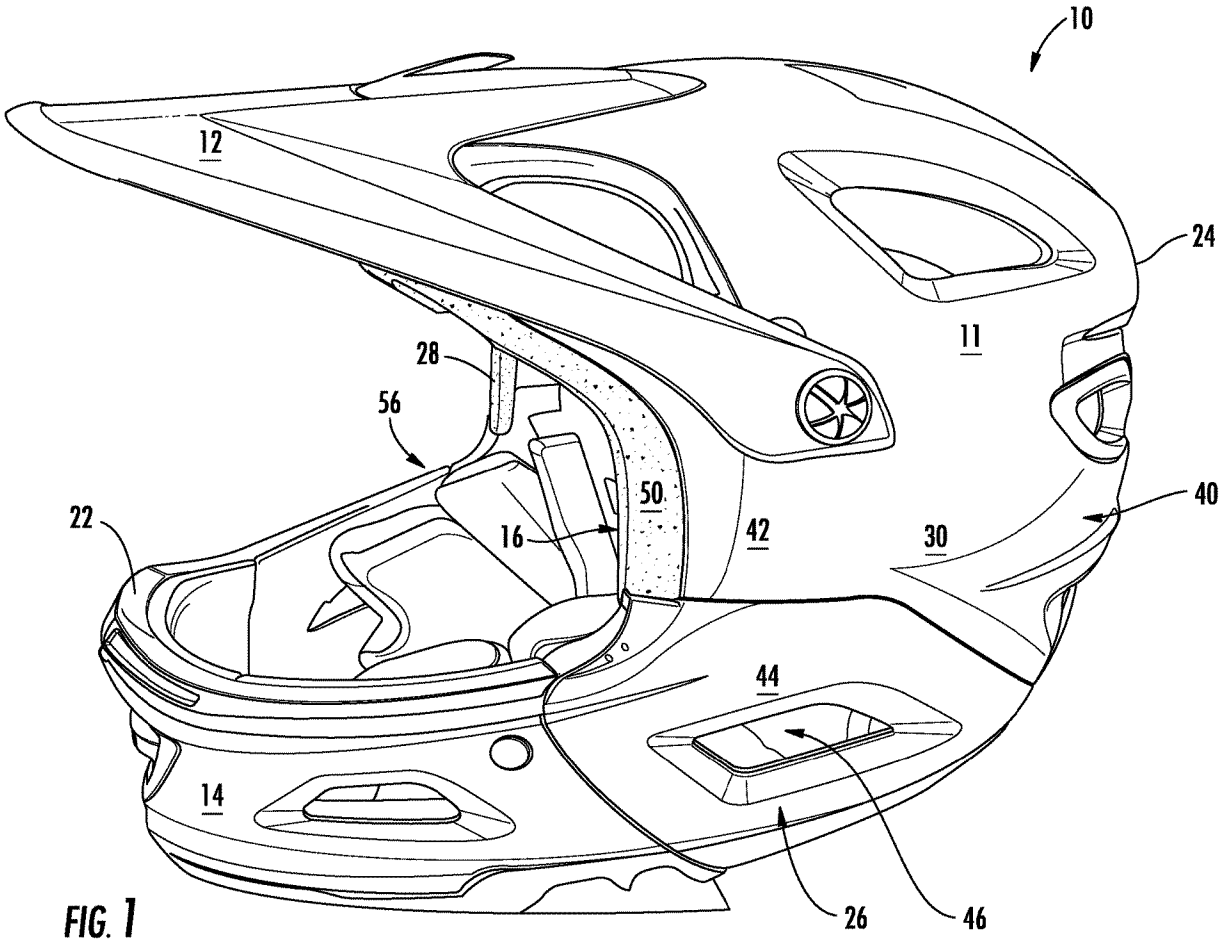
FIG. 1 shows a perspective view of an embodiment of a helmet with airflow ventilation through an earpad.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a helmet or protective helmet 10 that can include an outer shell and an inner energy-absorbing layer, such as foam. The helmet can be flexible, adjustable, or both, and can be used by a cyclist, biker, motorcycle rider, motocross racer, power sports rider, skateboarder, skier, skater, downhill rider, or other athlete. Each of the above listed sports or activities can use a helmet that includes either single or multi-impact rated protective material base that is typically, though not always, covered on the outside by a decorative cover and includes comfort material on at least portions of the inside, usually in the form of comfort padding.

FIG. 1 shows a perspective side view of the helmet 10, and shows the helmet 10 can optionally include a helmet body 11, a visor 12, a chinbar 14, a faceport 16, and a cavity 18, into which a user, wearer, or rider 20 of the helmet of the helmet 10 can place his head. The chinbar 14, when present, can be a detachable chinbar that can be releasably coupled to the helmet body 11 by the user 20. As shown in FIG. 1, the detachable chinbar 14 can be coupled to the helmet body 11 to provide additional protection to the user 10 as part of a full face helmet 10. The additional protection can be desirable, for example, when the user 20 is riding downhill. When the user 20 is moving uphill, across level ground, or at slower speeds, the chinbar 14 can be removed for a more minimalist type helmet. A view of the helmet 10 with the chinbar 14 removed from the helmet 10 is shown, for example, in FIG. 2A.

As used herein, the terms front, back, left, and right, are used for convenience in describing relative positions and portions of the helmet 10, and are made with respect to the helmet 10 in reference to the front, back, left, and right of the user 20 when wearing the helmet 10. As such, the front 22 of the helmet 10, the back 24 of the helmet 10, the left 26 of the helmet 10, and right 28 of the helmet 10 are not by way of limitation, and different helmet orientations and descriptions can be used in reference to the helmet 10.

The helmet 10 can comprise, and can be formed at least in part of, a shell, protective shell, or an outer shell 40 and an energy absorbing material or impact liner 50. The shell 40 can be made of a flexible or semi-flexible material that can comprise plastics, including Acrylonitrile Butadiene Styrene (ABS), polycarbonate, Kevlar, various metal alloys, fiber materials or fiber reinforced materials including fiberglass, carbon fiber, fiber-reinforced plastic, aramid, or other suitable material. A non-limiting example of a possible ABS plastic that can be used for the outer shell is Cycolac® EX39, by GE Plastics. The shell 40 can comprise a flexural strength greater or equal to 2.76 gigapascals (or 400,000 pounds per square inch (psi)). The shell 40 can also comprise a flexural strength greater or equal to 1.86 gigapascals (or 270,000 pounds per square inch (psi)). The shell 40 is typically made hard enough to resist impacts and punctures, and to meet the related safety testing standards, while being flexible enough to deform slightly during impacts to absorb energy through deformation, thereby contributing to energy management and protection of the helmet wearer.

The shell 40 can comprise an outer surface 42 and an inner surface 44 opposite the outer surface 42. In some instances, the shell 40 can be the outermost layer of the helmet. In other instances, the shell 40 can have additional functional or aesthetic covers or layers formed on an outer surface 42 of the shell 40.

The energy-absorbing material 50 can comprise one or more layers of foam, plastic, polymer, or other suitable energy-absorbing material to absorb energy and to contribute to energy management for protecting the user 20 during impact. Energy-absorbing material 50 can, without limitation, include EPS, EPU, EPO, EPP, or VN. The energy-absorbing material 50 can be an in-molded layer or can be coupled to the shell 40 after molding. In some embodiments, the energy-absorbing material 50 can absorb energy from an impact by being crushed or cracked. As a non-limiting example, the helmet 10 can be formed as a 1-piece in-mold helmet, as a 2-piece in-mold helmet, or as an in-mold comprising any number of pieces. Alternatively, the energy-absorbing material 50 can be made of plastic, polymer, foam, or other suitable energy-absorbing material that can flexibly deform with the shell 40 to absorb energy and to contribute to energy management without breaking, cracking, or being crushed. As such, the energy-absorbing material 50 can also be one or more layers of EPP or other similar energy-absorbing and energy-attenuating material that is flexible and able to withstand multiple impacts without being crushed or cracking.

The energy-absorbing material 50 can comprise an outer surface 52 and an inner surface 54 opposite the outer surface 52. The energy-absorbing material 50, such as the outer surface 52, can be coupled to the inner surface 44 of the protective shell 40 to form a cavity or interior 56 of helmet 10 for receiving a head of the user 20. The energy-absorbing material 50 can be permanently or removably coupled to the shell 40, either mechanically, chemically, or both, such as with a friction fit, or with a glue, adhesive, permanent adhesive, PSA, foam-core PSA, tape, two-sided tape, mounting foam adhesive, fastener, clip, cleat, cutout, tab, snap, rivet, hog ring or hook and loop fasteners. The energy-absorbing material 50, alone and together with the shell 40, can provide energy management and protection to the user 20.

The energy-absorbing material 50, like the shell 40, can also comprise one or more ventilation openings 46 that can be formed through the protective shell 40 and extend into the cavity 56 to allow for the passage of air, ventilation, and airflow from outside the helmet to the head of the wearer 20.

One or more additional layers of comfort padding or a comfort liner 60 can be optionally disposed within the cavity 56 and coupled to a portion of the helmet 10, such as one or more of the energy-absorbing material 50, the shell 40, and an earpad or pad 80. The comfort padding 60 can comprise compressible foam or other suitably deformable material, with or without a cloth covering, which can contact a face or head of the user 20 to comfortably fit the helmet 10 to the user 20. The comfort padding 60 can comprise one or more portions or pieces, including a comfort cheek pad 62, that can be disposed within the cavity 56 so as to provide support and cushion to or near a cheek of the user 20. While the comfort cheek pad 62 is, for convenience, referred to herein as a cheek pad to designate a possible location of the pad 62 near, adjacent, over, or around a cheek of the user 20, the pad 62 is not so limited. The pad 62 can also be formed as, near, adjacent, over, or around an ear 21 or jaw of the user 20 as an earpad, jaw pad, face pad, or head pad.

Figure 2A:
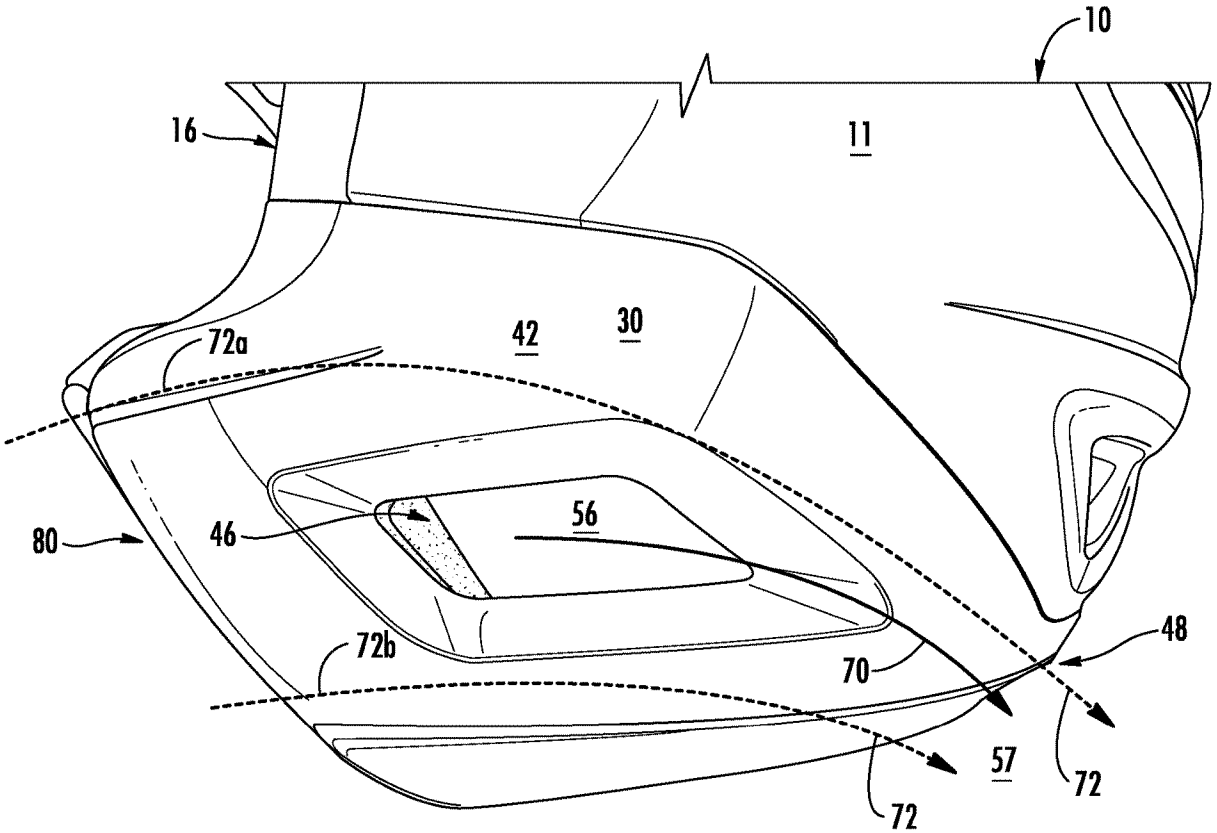
FIGS. 2A-2D show various views of an embodiment of a helmet earpad and airflow paths through the helmet earpad.

FIG. 2A shows a close-up profile view of a portion of the helmet 10, including a portion of the helmet body 11 near the ventilation opening 46 with the chinbar 14 removed from the helmet body 11. FIG. 2A shows the outer surface 42 of shell 40 as being solid and opaque, with the earpad or pad 80 disposed behind, or within the shell 40 and hidden from view. FIG. 2A additionally shows various airflow paths through the helmet 10, including airflow or an airflow path 70 through ventilation openings 46 and airflow or an airflow path 72 through earpad or pad 80. A direction of the airflow 70 can vary based on relative positioning and movement of the helmet 10 and use by the user 20. In some instances, the airflow 70 can travel through the ventilation opening 46, such as from the cavity or interior 56 of the helmet 10 or from through the earpad 80, to an exterior or ambient space outside of the helmet 57. A direction of the airflow 72 can be through the earpad 80, across an ear of the user 20, and exiting at the bottom or lower edge 48 of the helmet 10.

Figure 2B:
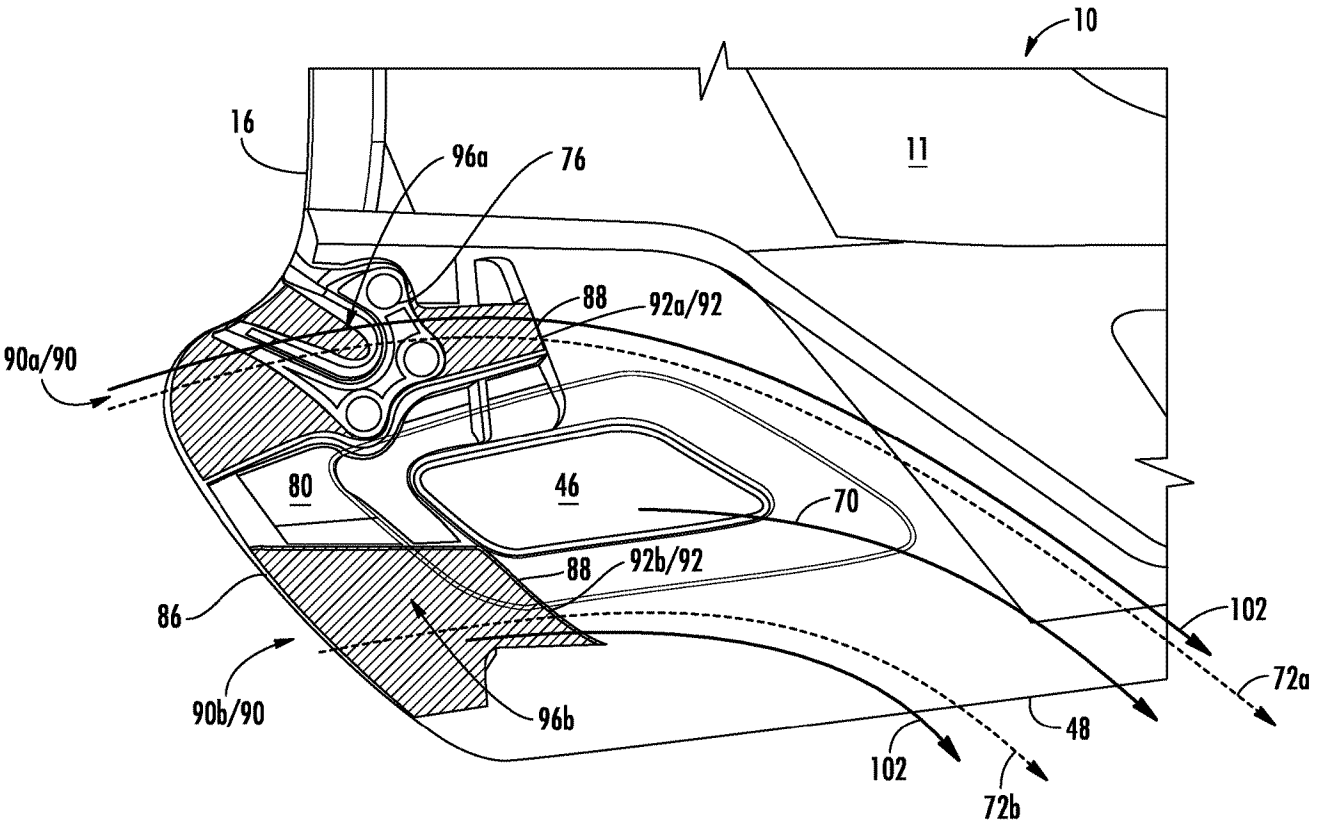

FIG. 2B shows a close-up profile view of a portion of the left side 26 of the helmet 10, similar to the view shown in FIG. 2A. FIG. 2B also shows airflow path 70 through the ventilation opening 46 and the airflow paths 72 through earpad or pad 80. While the earpad or pad 80 is, for convenience, referred to herein as an earpad to designate a possible location of the pad 80 near, adjacent, over, or around the ear 21 of the user 20, the pad 80 is not so limited. The earpad 80 can also be formed as, near, adjacent, over, or around an cheek or jaw of the user 20 as a cheek pad, jaw pad, face pad, or head pad. The earpad 80 can also be formed as, near, adjacent, over, or around the energy absorbing material 50. The airflow paths 72 can include one or more airflow paths, such as an upper airflow or an upper airflow path 72*a* through the earpad 80 and a lower airflow or lower airflow path 72*b* through the earpad 80. FIG. 2B differs from FIG. 2A by showing a portion of the shell 40 as being transparent to reveal the earpad 80 disposed within the shell 40 and coupled to an inner surface 44 of the shell 40.

The earpad 80 can comprise, or can be created using, one or more layers of semi-rigid foam materials or flexible materials, such as Ethylene Vinyl Acetate Copolymer (EVA), Vinyl Nitrile (VN), polyurethane (PU), or other suitable material. The earpad 80 can comprise an inner surface 82 that further defines the cavity 56, and an outer surface 84 opposite the inner surface 82. The outer surface 84 can be mateably coupled with the inner surface 44 of the shell 40. The earpad 80 can further comprise a leading edge or leading surface 86 at, or oriented in a direction of, the front 22 of the helmet 10. The leading edge 86 can extend between the inner surface 44 of the shell 40 and the inner surface 82 of the earpad 80.

In some instances, such as that shown in FIG. 2B, the removable chinbar 14 can be removed from the helmet body 11, and can be removably coupled to the helmet body 11 at chinbar receiver or bracket 76. The chinbar bracket 76 can be positioned at any desirable location within the helmet body 11, including between the inner surface 44 of the shell 40 and the inner surface 82 of the earpad 80.

The earpad 80 can also comprise one or more air intake openings 90 formed at the leading edge 86 of the earpad 80. In some instances, the air intake openings 90 can be formed as an upper air intake opening 90*a* and a lower air intake opening 90*b*. The leading edge 86 can be the front portion of the earpad 80 that first contacts air flowing towards the helmet 10 during use. The leading edge 86 can be a planar or non-planar contoured surface comprising ridges, edges, chine lines, or other structures, as desired. A trailing edge or trailing surface 88 can be formed opposite the leading edge 86, and can be the back or rear portion of the earpad 80 that last contacts air flowing across and away from the helmet 10 during use. The trailing edge 86 can be a planar or non-planar contoured surface comprising ridges, edges, chine lines, or other structures, as desired. One or more air exhaust openings 92 can be formed at the trailing edge 88 of the earpad 80. In some instances, the air intake exhaust openings 92 can be formed as an upper air exhaust opening 92*a* and a lower air exhaust opening 92*b*.

One or more airflow channels 96 can be formed in, and extend through, the earpad 80. In some instances, the airflow channel can be completely formed in, or be defined by, the earpad 80. In other instances, the airflow channels 96 can be partially formed in, or be defined by, the earpad 80 while also being at least partially formed or defined by the shell 40, such as the inner surface 44 of the shell 40. Thus, the airflow channels 96 can be through layers or materials of the helmet 10 that are not specifically included for energy management, but are for user comfort, or for improving a fit of the helmet 10. In other instances, the airflow channels 96 can be partially or completely through the energy absorbing material or impact liner 50. When the airflow channels 96 are formed in the one or more earpads 80, the airflow channels 96 can be partially or completely contained within the shell 40, or the earpads 80. As such, the airflow channels 96 can extend between the air intake openings 90 and the air exhaust openings 92. As shown in FIG. 2B, an upper airflow channel 96*a* can extend between the upper air intake opening 90*a* and the upper air exhaust opening 92*a*, thus forming the upper airflow path 72*a* for a desired air current or airflow. Similarly, a lower airflow channel 96*b* can extend between the lower air intake opening 90*b* and the lower air exhaust opening 92*b*, thus forming the lower airflow path 72*b* for a desired air current or airflow.

As such, a direction of the airflow channels 96, and a direction of the airflow, such as along the airflow paths 72, are not in a radial direction between the cavity 56 and an outer surface o exterior 30 of the helmet 10 as is the case with ventilation openings 46. Stated another way, the airflow channel 96 can be in a direction perpendicular or substantially perpendicular to the leading edge 86. Thus, the airflow channels 96 can be used in addition to, and in a different way than, ventilation openings 46 to improve ventilation and airflow for the user 20 wearing the helmet 10 by having airflow through the earpad 80, or other similar pad within the outer shell 40, separate from the energy absorbing material 50. In some instances, the air intake openings 90 can be exposed when the removable chinbar 14 is removed from the helmet body 11. Stated another way, the air intake openings 90 can be blocked or covered when the removable chinbar 14 is releasably coupled to the helmet body 11, such as through chinbar receiver 74.

Thus, as shown in FIG. 2B, a direction or contour of the airflow channels 96, and a direction of the airflow, such as along the airflow paths 72 within the helmet 10 can match or substantially match a contour of airflow 102 along the outer surface 30 of the helmet 10 or shell 40. As shown in FIG. 2B, the airflow 102 illustrates a direction of airflow on the exterior or outer surface 42 of the helmet 10, parallel or substantially parallel, to the airflow 72 through the earpad 80 or within the interior 56 of the helmet 10. As used herein, substantially parallel is a direction or angle within 0-45 degrees, or 0-30 degrees of parallel. The air exhaust openings 92 can be positioned so that the airflow path 72 extends along, and exits the helmet 10 at a bottom back 24 of the helmet 10, or along the bottom or lower edge 48 of the helmet 10 or shell 40. Similarly, the airflow paths 72 and the airflow channels 96 can include a geometry, shape, cross-sectional size, cross-sectional area, or curvature that facilitates a maximum, optimal, or desirable amount of airflow. A shape of the airflow channels 96 between the air intake openings 90 and the air exhaust openings 92 can comprise a curved shape or an arch shape. In some instances, an amount of airflow 72 can be adjusted by the user 20 to provide for more or less cooling based a preference of the user 20 and based on variable environmental conditions. Variable airflow 72 can be user defined and adjustable by changings a size, shape, position, or relative angle of the one or more air intake openings 90 or the one or more air exhaust openings 92. In some instances, the user 20 can define the airflow 72 by adjusting a cover, vent, latch, or door at the air intake opening 90 or the air exhaust opening 92.

In some instances, the one or more air intake openings 90 or air exhaust openings 92 can be covered with a net, mesh, or grate, to provide more protection than an open area, such as from projectiles or puncturing by objects that might cause injury to a user. The net, mesh, or grate can also prevent debris or airborne particles from entering the one or more air intake openings 90 or air exhaust openings 92 as well as the airflow channels 96 and undesirably blocking or diminishing the airflow 72.

Figure 2C:
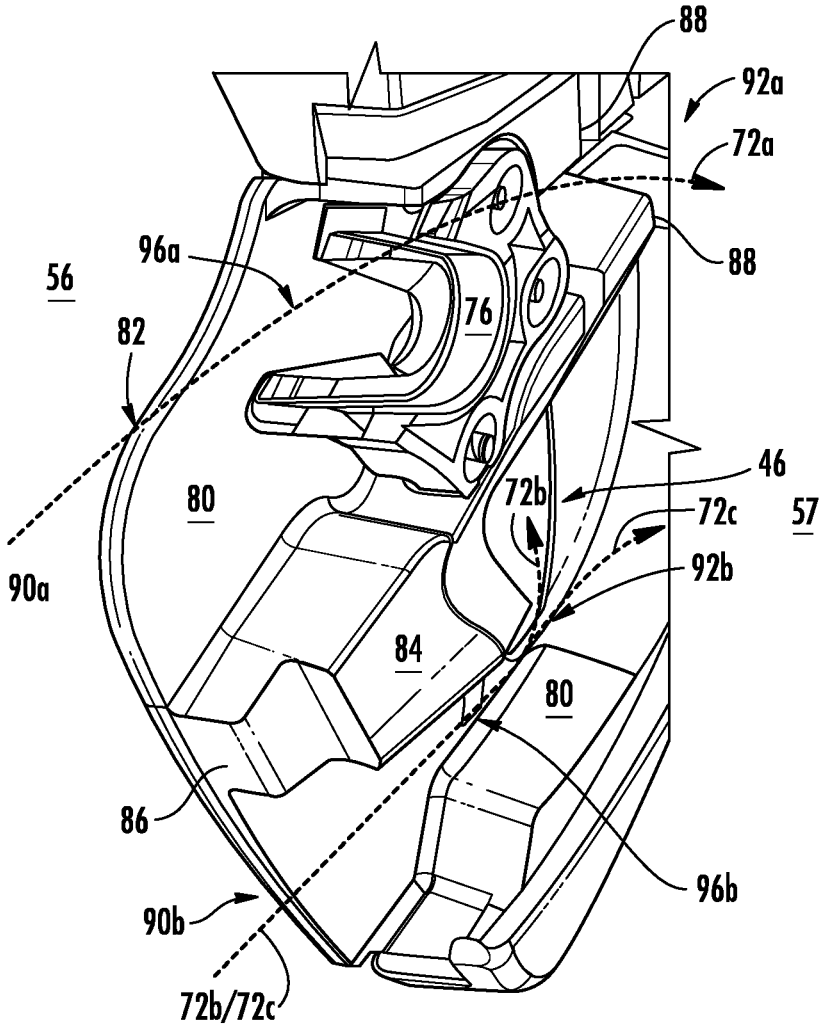

FIG. 2C shows a close-up perspective view of a portion of the left side 26 of the helmet 10, similar to the portion of the helmet shown in the profile view of FIG. 2B. As shown, the airflow 72*b* can exit the helmet 10 at the bottom or lower edge 48 of the helmet 10 after flowing across the ear 21 of the user 20. There can also be an element of air transfer or air exchange that occurs from the one or more airflow channels 96 through the vent 46 as illustrated by the airflow 72*c*. The flow of airflow 72*c* can also be a part of, and mix with, airflow 70 shown in FIG. 2A, in which the airflow 70 can come partly or completely from the cavity 56, such as through faceport 16, and partly or completely through the one or more airflow channels 96.

Figure 2D:
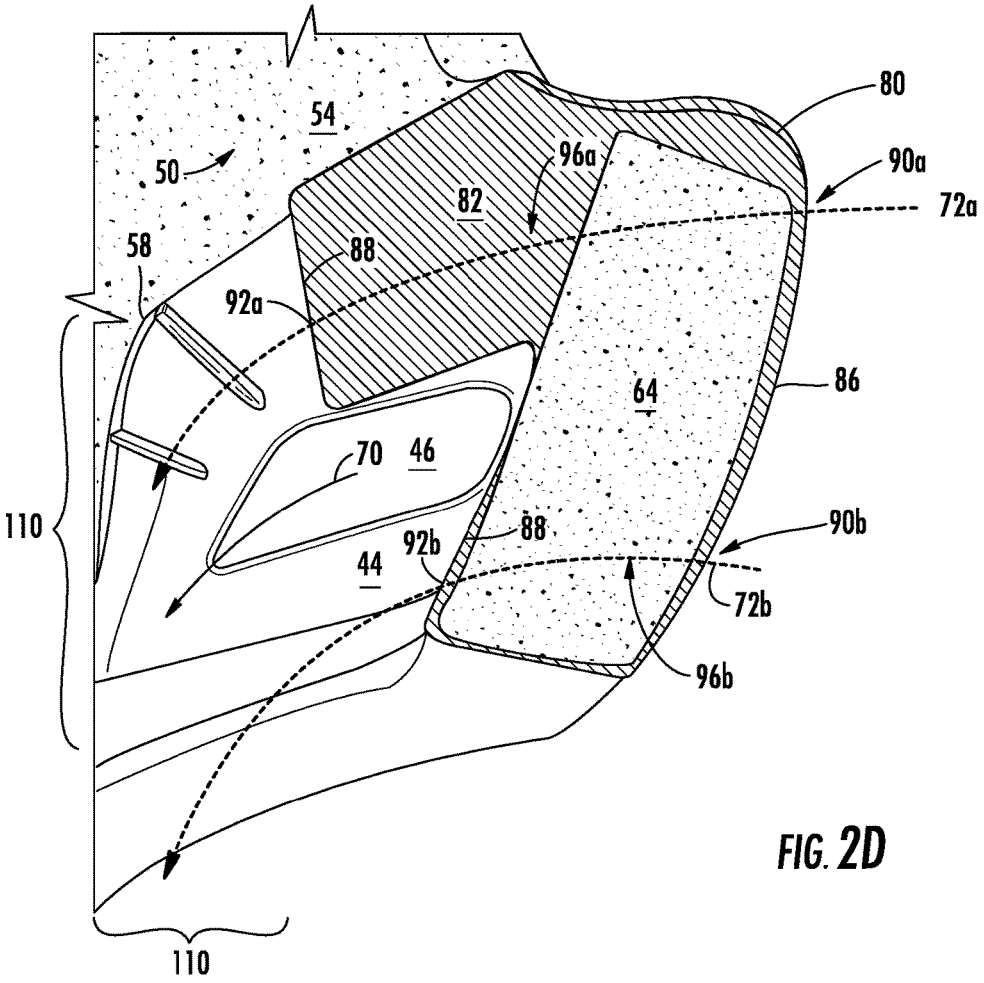

FIG. 2D shows a close-up profile view of a portion of the left side 26 of the helmet 10, similar to the portion of the helmet shown in the profile view of FIG. 2B. FIG. 2D differs from FIG. 2B in that FIG. 2D shows the inner surface 82 of earpad 80 and the inner surface 44 of shell 40, as seen from the cavity 56 for the head of the user 20. The earpad 80 can be directly coupled to the inner surface 44 of the shell 40, like the energy absorbing material 50 can be directly attached to the inner surface 44 of the shell 40. Thus, the earpad 80 can be directly coupled to the inner surface 44 of the shell 40 without the energy absorbing material 50 being disposed between the earpad 80 and the shell 40. With the energy absorbing material 50 and the earpad 80 both being directly attached to the shell 40, the energy absorbing material 50 and the earpad 80 can also be positioned adjacent, or offset from, each other.

In some instances, the energy absorbing material 50 and the earpad 80 can also be positioned within the shell 40 so as to create one or more spaces 110 for receiving the ear 21 of the user 20. The space 110 can be defined by, and extend between, an edge 58 of the energy absorbing material 50 and the air exhaust openings 92, trailing edge 88, or both, of the earpad 80. The space 110 can be adjacent, or overlap with, the ventilation opening 46 and inline or along the airflow path 70. Similarly, the space 110 can also be adjacent the air exhaust openings 92 of the earpad 80 and inline or along the airflow paths 72. As such, airflow through the earpads 80 of the helmet 10 can provide cooling for the user 20 by allowing for air to circulate near or adjacent the head, ear, or both, of the user 20 through and around the space 110. In some instances, openings in the earpads 80 can facilitate airflow, such as airflow 72, and cooling by directing desired airflow 70, 72, or both, with or without a protective chinbar 14 in place.

FIG. 2D also shows an attachment mechanism 64 can be coupled to the inner surface 82 of earpad 80, the attachment mechanism 64 attaching the comfort padding 60 or the comfort cheek pad 62 to the earpad 80. The attachment mechanism 64 can be a mechanical attachment mechanism, a chemical attachment mechanism, or both, such as with a friction fit, or with a glue, adhesive, permanent adhesive, PSA, foam-core PSA, tape, two-sided tape, mounting foam adhesive, fastener, clip, cleat, cutout, tab, snap, rivet, hog ring, or hook and loop fasteners. In some instances, the attachment mechanism allows the comfort cheek pad 62 to be releasably coupled to the earpad 80.

Figure 3:
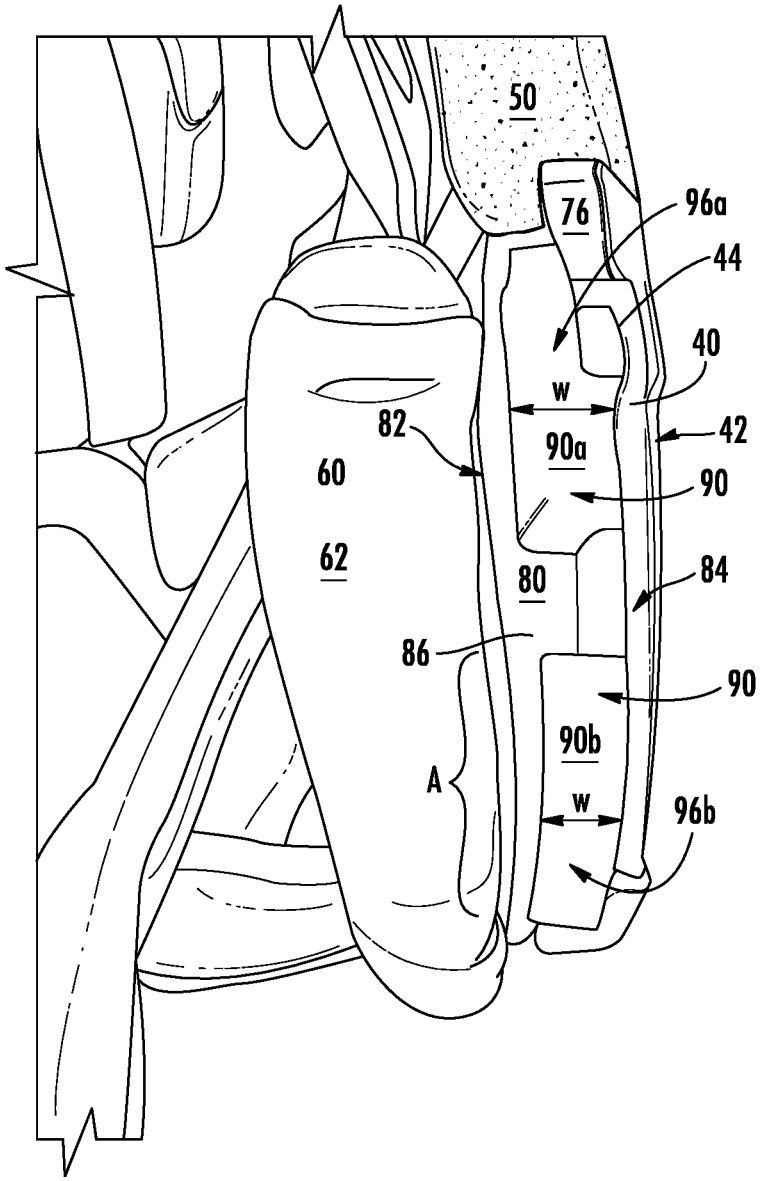
FIG. 3 shows an embodiment of an earpad with airflow channels coupled to a helmet protective shell.

FIG. 3 shows a front profile view of a portion of the left side 26 of the helmet 10, in which the shell 40, the energy absorbing material 50, the earpiece 80 and the comfort cheek pad 62 are shown. The one or more airflow channels 96 can comprise a width or diameter W and an area A of any suitable size that advantageously increases airflow and provides additional airflow pathways compared to conventional helmets. As such, the width W and the area A can be of any suitable size, and can accommodate differing mechanical requirements of the helmet 10 as well as functional and aesthetic profiles of the helmet 10. As non-limiting examples, the width W of the one or more airflow channels 96 can be greater than or equal to 1 millimeter (mm), or greater than or equal to 5 mm. Similarly, the area or cross-sectional area A of the one or more air channels 96 can be greater than or equal to 1 square millimeters ($mm^2$), 5 $mm^2$, or 25 square $mm^2$. While the airflow channels 96 are shown with cross-sectional areas A that are open, clear, or single channels, the airflow channels 96 may alternatively comprise sections or divisions comprised of multiple smaller channels, tubes, or segments shaped with honeycomb, square, circular, or any other cross-sectional shape. The comfort padding 60, such as the cheek pad 62, can be releasably coupled to the inner surface 82 of the earpad 80 and disposed within the cavity 56.

Figure 4:
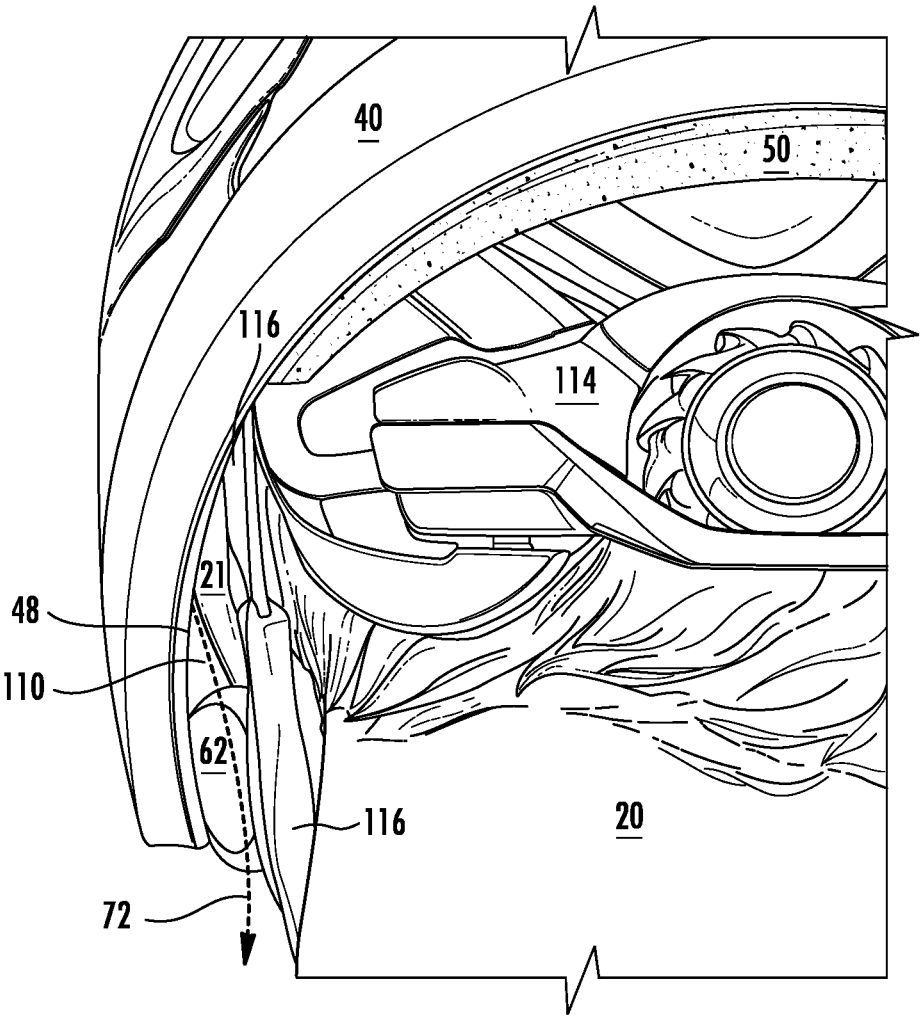
FIG. 4 shows a rear view of an embodiment of a helmet with airflow ventilation through an earpad being worn by a user.

FIG. 4 shows a perspective view of a portion of the back 24 and of the left side 26 of the helmet 10, in which a portion of the head of the user 20 is also shown disposed within the cavity 56 as seen from behind the helmet 10. The helmet 10 is shown releasably coupled to the head of the user 20 with a helmet fit system 114 and a helmet strap 116. The space 110 is shown extending between the shell 40 and the ear 21 of the user 20, adjacent the comfort padding 60 or the comfort cheek pad 62. The ear 21 of the user 20 is situated within the space 110 and along the airflow or airflow path 70 and the airflow or airflow path 72 that can exit at, near, or along, the bottom or lower edge 48 of the helmet 10 or shell 40.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising:

a protective shell comprising an outer surface at an exterior of the helmet and an inner surface opposite the outer surface;

a layer of energy management material coupled to the inner surface of the protective shell to form a cavity for receiving a head of a user; and an earpad coupled to the inner surface of the protective shell that comprises an inner surface that further defines a space for an ear of a user, the earpad further comprising:

a leading edge at a front of the helmet, the leading edge extending between the outer surface of the protective shell and the inner surface of the earpad, an air intake opening formed at the leading edge of the earpad, an air exhaust opening formed at a trailing edge of the earpad, and an airflow channel extending through the earpad between the air intake opening and the air exhaust opening.

2. The helmet of claim 1, further comprising a ventilation opening formed through the protective shell that extends into the cavity.

3. The helmet of claim 1, further comprising a foam comfort pad coupled to the inner surface of the earpad and disposed within the cavity.

4. The helmet of claim 1, further comprising a removable chinbar, wherein the air intake opening is blocked when the removable chinbar is coupled to the protective shell with a chinbar bracket.

5. The helmet of claim 1, wherein the airflow channel comprises a width greater than or equal to 1 millimeter.

6. The helmet of claim 1, wherein the airflow channel comprises a cross-sectional area greater than or equal to 5 square millimeters.

7. The helmet of claim 1, wherein the air exhaust opening is located along a bottom edge of the helmet.

8. The helmet of claim 1, wherein the earpad is coupled adjacent the layer of energy management material.

9. A helmet, comprising:

a protective shell comprising an outer surface and an inner surface opposite the outer surface;

a layer of energy management material coupled to the inner surface of the protective shell to form a cavity for receiving a head of a user; and an earpad coupled to the inner surface of the protective shell that comprises an inner surface that further defines a space for an ear of a user, the earpad further comprising:

an air intake opening in a leading edge of the earpad, an air exhaust opening, and an airflow channel extending through the earpad between the air intake opening and the air exhaust opening.

10. The helmet of claim 9, further comprising a ventilation opening formed through the protective shell that extends into the cavity.

11. The helmet of claim 9, further comprising a foam comfort pad coupled to the inner surface of the earpad and disposed within the cavity.

12. The helmet of claim 11, wherein the earpad is coupled adjacent the layer of energy management material.

13. The helmet of claim 9, wherein the airflow channel comprises a cross-sectional area greater than or equal to 5 square millimeters.

14. The helmet of claim 9, wherein the air exhaust opening is located along a bottom edge of the helmet.

15. A helmet, comprising:

a protective shell comprising an outer surface and an inner surface opposite the outer surface;

a layer of energy management material coupled to the inner surface of the protective shell; and an earpad coupled to the inner surface of the protective shell that defines a space for an ear of a user, the earpad further comprising an airflow channel that extends from an opening in a leading edge of the earpad through the earpad to a trailing edge of the earpad opposite the leading edge of the earpad.

16. The helmet of claim 15, further comprising a ventilation opening formed through the protective shell and extending in a direction within 0-30 degrees of perpendicular to the airflow channel.

17. The helmet of claim 15, further comprising a foam comfort pad coupled to an inner surface of the earpad.

18. The helmet of claim 15, further comprising a removable chinbar, wherein the airflow channel is blocked when the removable chinbar is coupled to the protective shell with a chinbar bracket.

19. The helmet of claim 15, wherein the airflow channel comprises a width greater than or equal to 1 millimeter.

20. The helmet of claim 15, wherein the earpad is coupled adjacent the layer of energy management material.

* * * * *